United States Patent [19]

Hagemeister

[11] Patent Number: 4,729,550

[45] Date of Patent: Mar. 8, 1988

[54] SPRING MODULE

[75] Inventor: Robert C. Hagemeister, Boston, Mass.

[73] Assignee: Webster Spring Co. Inc., Oxford, Mass.

[21] Appl. No.: 869,706

[22] Filed: Jun. 2, 1986

[51] Int. Cl.[4] ..... F16F 3/00; A47C 23/02; A47C 27/04

[52] U.S. Cl. ..... 267/103; 5/247; 5/476; 267/107

[58] Field of Search ..... 267/91, 103, 107, 108, 267/109, 111; 5/247, 248, 255, 264 B, 271, 476, 269

[56] References Cited

U.S. PATENT DOCUMENTS 3,657,749 4/1972 Norman ..... 267/91 X

FOREIGN PATENT DOCUMENTS 943580 3/1949 France ..... 5/269

*Primary Examiner*—Andres Kashnikow
*Assistant Examiner*—Robert J. Oberleitner
*Attorney, Agent, or Firm*—Robert T. Gammons

[57] ABSTRACT

A bent wire spring module wherein there are upper and lower attaching elements for attachment, respectively, to a grid frame and base frame and vertically-disposed, spaced, parallel legs connecting the upper and lower attaching elements, each leg comprising an arcuate length of wire embodying diverging legs and upper and lower straight lengths of wire integrally connected at one end to the ends of the legs of the arcuate length of wire and at their opposite ends to the upper and lower attaching elements.

2 Claims, 6 Drawing Figures

SPRING MODULE

BACKGROUND OF THE INVENTION

In my U.S. Pat. No. 4,685,659, there is disclosed a spring module wherein upper and lower attaching elements are yieldably connected by spaced, parallel lengths of wire of opposite symmetry wherein the lengths of wire each comprise inclined and vertical supports. The disposition of the inclined and vertical segments as disclosed in the aforesaid module is designed to affored yield which is relatively stiff. It is the purpose of this invention to structure the module so as to provide for softer yield and to insure repeated yield without stress hardening.

SUMMARY OF THE INVENTION

As herein illustrated, the invention resides in a spring module for disposition between a base frame and a grid frame for attachment, respectively, to the base frame and grid frame comprising an attaching element at the lower end, an attaching element at the upper end and resilient supporting elements yieldably connecting the attaching elements comprising vertically-disposed, spaced parallel supports, each support comprising an arcuate length of wire located substantially midway between the upper and lower attaching elements, each defining a pair of diverging legs, said arcuate lengths of wire being disposed so as to face in opposite directions with respect to each other and straight lengths of wire integrally connected at one end to the ends of the legs of the arcuate lengths of wire and at the other ends to the attaching elements, said straight lengths of wire extending from the ends of the arcuate lengths of wire in directions opposite to the legs of the arcuate lengths of wire at acute angles thereto and being connected at their ends to the attaching elements. The straight lengths of wire diverge from the legs of the arcuate lengths of wire. The lower attaching elements comprise spaced, parallel lengths of wire connected at one end to one of the lower ends of the respective lower lengths of wire and at their other ends to the ends of a diagonal length of wire. The upper attaching elements comprise spaced, parallel lengths of wire connected at one end to one of the upper ends of the respective upper lengths of wire and at their other ends to the ends of a diagonal length of wire.

The invention will now be described with reference to the accompanying drawings, wherein.

Figure 1:
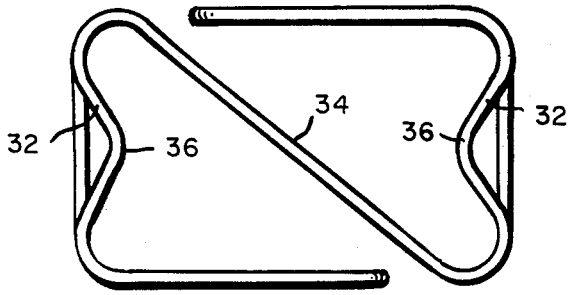
FIG. 1 is an elevation of the spring module as seen from one side.
Figure 5:
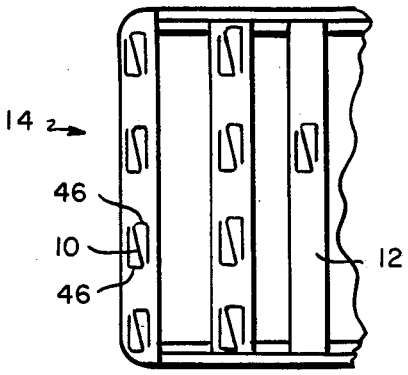
FIG. 5 is a plan view of the base frame to which the lower ends of the spring modules are attached.
Figure 2:
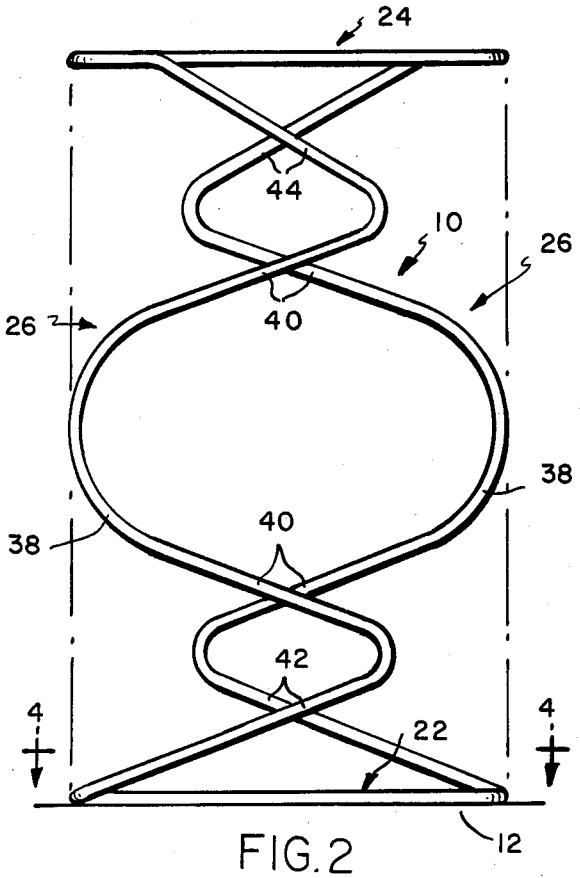
FIG. 2 is an elevation of the spring module shown in FIG. 1 as seen at right angles thereto.
Figure 3:
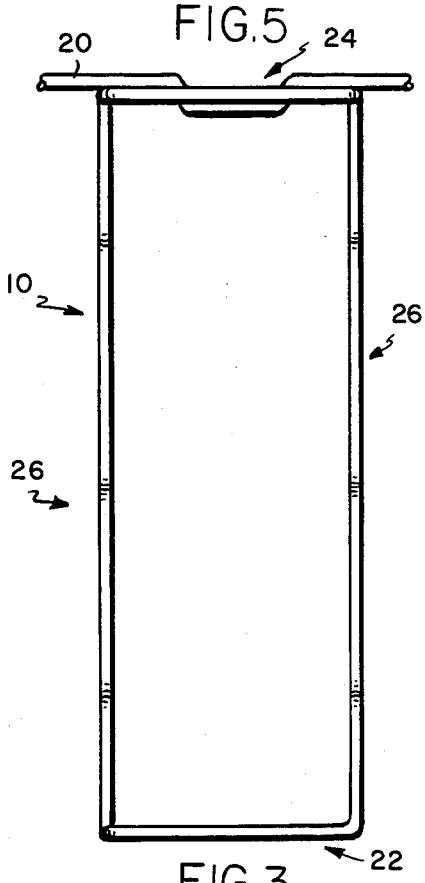
FIG. 3 is a top plan view of the spring module.
Figure 4:
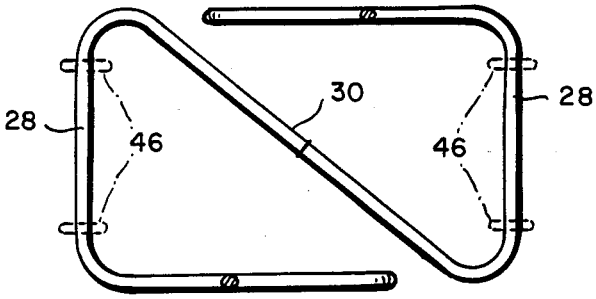
FIG. 4 is a bottom plan view of the spring module.
Figure 6:
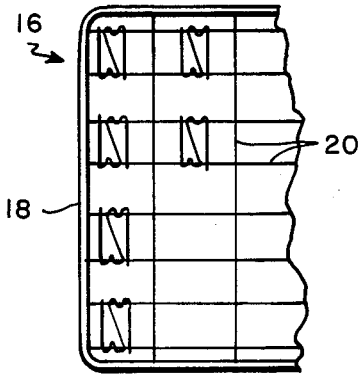
FIG. 6 is a plan view of the grid frame to which the upper ends of the spring modules are attached.

Referring to the drawings, the spring module 10 structured according to this invention is disposed between the crossbars 12 of a base frame such as shown in FIG. 5 as being comprised of a rectangular frame 14 provided with spaced, parallel cross bars 12 and a grid frame 16 such as shown in FIG. 6 as being comprised of a rectangular frame 18 provided with longitudinally and transversely-spaced cross wires 20.

The modules 10 are spaced transversely and longitudinally of the base and grid frames and each comprises a lower attaching element 22, and upper attaching element 24 and intervening resilient supports 26—26. The lower attaching element 22 comprises spaced, parallel lengths of wire 28—28 joined at one end by a diagonal length of wire 30. The upper attaching element 24 comprises spaced, parallel lengths of wire 32—32 connected at one end by a diagonal length of wire 34. The lengths of wire 32—32 desirably contain deviations 36—36.

The intervening resilient supports 26—26 which connect and support the upper and lower attaching elements in spaced, parallel relation to each other comprise spaced, parallel, vertically-disposed arcuate lengths of wire 38—38 tangent to vertical projections of the top and bottom attaching elements and facing in opposite directions, said arcuate lengths of wire having diverging legs 40—40, the legs of the arcuate lengths at the respective sides of the unit being inclined in opposite directions. Straight lengths of wire 42—42 connect the lower legs of the arcuate lengths of wire to the attaching elements at the lower end and straight lengths of wire 44—44 connect the ends of the upper legs of the arcuate lengths of wire with the upper attaching elements. The straight lengths of wire 42—42 and 44—44 are connected to the legs 40—40 by arcuate lengths of wire 41—41 and 43—43 which are of smaller radius of curvature than the radius of curvature of the arcuate lengths of wire 38—38. The diverging legs of the U-shaped lengths of wire are disposed at acute angles with respect to the straight lengths of wire.

The modules are attached to the base frame 12 by means of staples 46—46 driven into the base frame over the wires 28—28 and to the grid frame by means of the deviations 36 to the cross wires 20.

It should be understood that the present disclosure is for the purpose of illustration only and includes all modifications or improvements which fall within the scope of the appended claims.

What is claimed is:

1. A spring module for disposition between a base frame and a grid frame for attachment, respectively, to the base frame and grid frame comprising an attaching element at the lower end, an attaching element at the upper end and resilient supporting elements yieldably connecting the attaching elements comprising vertically-disposed, spaced, parallel supports, each support comprising an arcuate length of wire located substantially midway between the upper and lower attaching elements, each defining a pair of diverging legs, said arcuate lengths of wire being disposed so as to face in opposite directions with respect to each other and upper and lower straight lengths of wire integrally connected at one end to the ends of the legs of the arcuate lengths of wire and at the other ends to the attaching elements, said upper and lower straight lengths of wire extending from the ends of the arcuate lengths of wire in directions opposite to the legs of the arcuate lengths of wire at acute angles thereto and being connected at their ends to the attaching element, said diverging legs of the arcuate lengths of wire being connected to the upper and lower straight lengths of wire by arcuate lengths of wire of smaller radius of curvature than the radius of curvature of the arcuate lengths of wire which connect the diverging legs and wherein said arcuate lengths of wire of smaller radius of curvature are located closer to the vertical axis of the module than are the arcuate lengths of wire of larger radius of curvature.

2. A spring module according to claim 1 wherein the arcuate lengths of wire of larger radius of curvature are tangent to the vertical projections of the top and bottom attaching elements.

* * * * *